US005584250A

United States Patent [19]

Berg

[11] Patent Number: 5,584,250

[45] Date of Patent: Dec. 17, 1996

[54] CENTER CLAMP ASSEMBLY FOR FRAME BRACE RAIL TRUCK

[75] Inventor: Thomas R. Berg, Clarendon Hills, Ill.

[73] Assignee: Standard Research and Design Corporation, Park Ridge, Ill.

[21] Appl. No.: 499,935

[22] Filed: Jul. 10, 1995

[51] Int. Cl.[6] ..... B61F 5/00

[52] U.S. Cl. ..... 105/182.1; 403/394

[58] Field of Search ..... 105/182.1, 165, 105/167, 168; 403/388, 394, 396, 400, 346

[56] References Cited

U.S. PATENT DOCUMENTS

| | | | |
|---|---|---|---|
| 5,243,920 | 9/1993 | Lamson et al. | 105/182.1 |
| 5,461,986 | 10/1995 | Sarnicki et al. | 105/165 |

FOREIGN PATENT DOCUMENTS

| | | | |
|---|---|---|---|
| 838218 | 3/1939 | France | 403/394 |
| 965188 | 9/1950 | France | 403/394 |
| 2123773 | 2/1984 | United Kingdom | 105/182.1 |

*Primary Examiner*—Mark T. Le
*Attorney, Agent, or Firm*—Dorn, McEachran, Jambor & Keating

[57] ABSTRACT

A rail car truck has a pair of longitudinally spaced wheelsets and a pair of laterally spaced side frames which extend between and are supported by the wheelsets. A bolster extends between the side frames to support the rail car vehicle body. There is a brace which is connected to the side frames to control relative longitudinal movement therebetween. The brace includes a pair of struts which are diagonally connected to the side frame on opposite sides of the centerline thereof. The struts intersect generally centrally of the side frames and there is a clamp assembly for attaching the struts together. The clamp assembly includes a pair of clamp plates, each having a channel formed and adapted to receive a strut. Each clamp plate is welded to a strut and there are fasteners which attach the facing surfaces of the clamp plates directly to each other. The clamp plates are welded one to another. The clamp assembly inhibits relative movement between the struts in a generally horizontal plane.

3 Claims, 2 Drawing Sheets

Fig. 1.
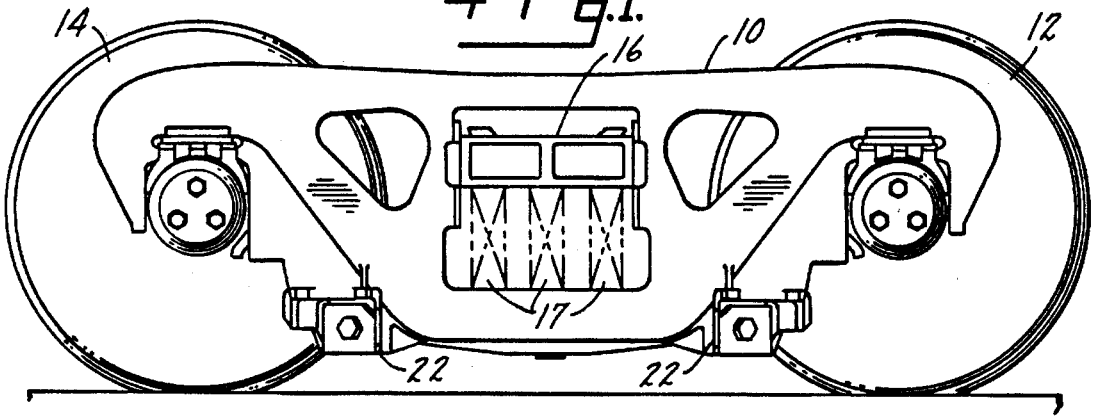
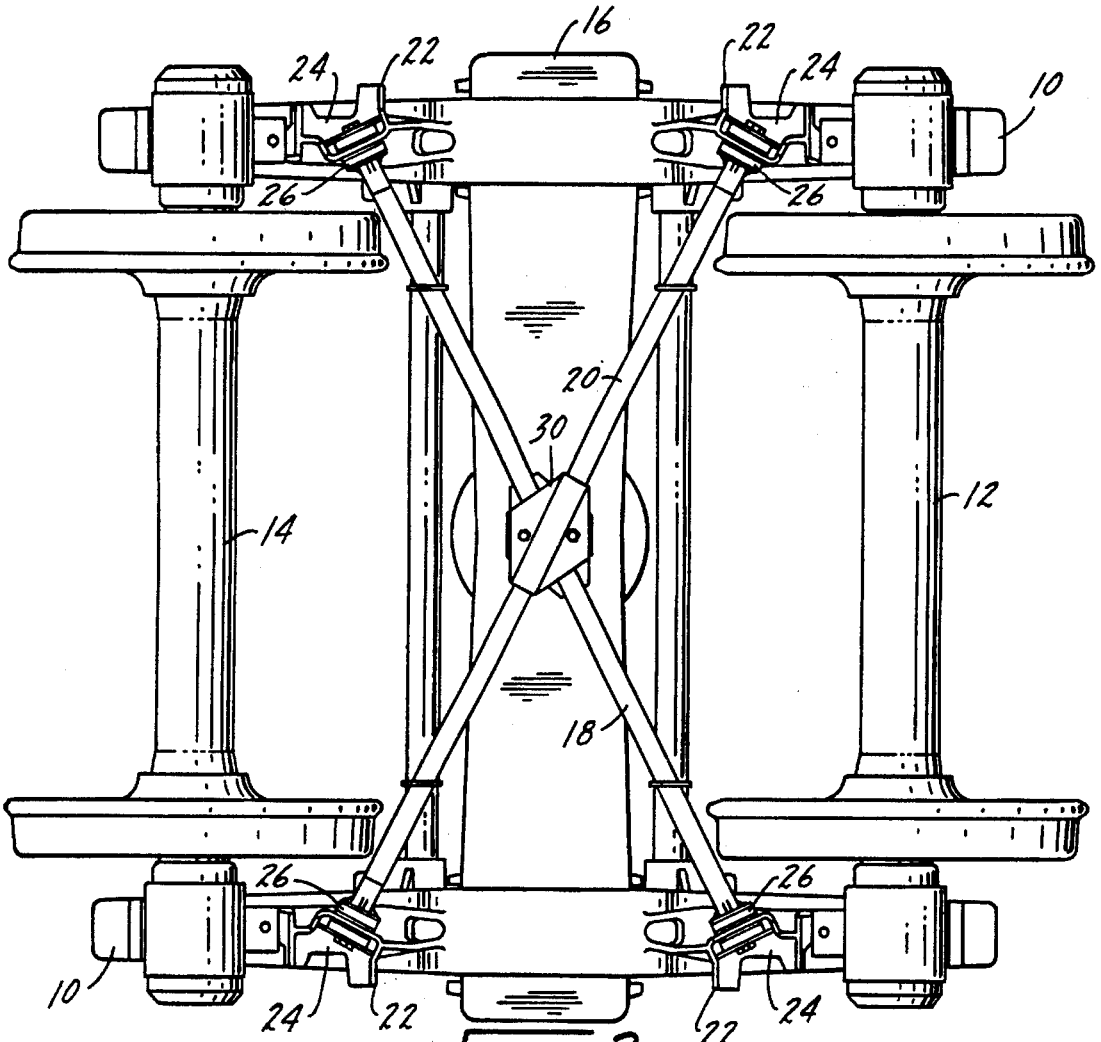
Fig. 2.

CENTER CLAMP ASSEMBLY FOR FRAME BRACE RAIL TRUCK

THE FIELD OF THE INVENTION

The present invention relates to frame braced rail car trucks of the type described in U.S. Pat. Nos. 4,570,544 and 5,243,920, both assigned to the assignee of the present application, Standard Research and Design Corporation of Park Ridge, Ill. In the '544 patent the diagonal braces or struts which interconnect the side frames are held together at their intersection by a shackle 66. In the '920 patent the struts are interconnected where they cross by a clamp plate assembly consisting of two clamp plates, each with a channel, and an elastomeric pad between the facing surfaces of the clamp plates and the struts. There are fasteners which hold the clamp plates together.

The present invention is an improvement on the clamp of the '920 patent in that it substantially strengthens the clamp assembly. The elastomeric pad of the '920 patent is eliminated, the size of the clamp plates has been increased, and the clamp plates are welded to the frame brace struts and the clamp plates are welded to one another. This welded assembly provides a substantially strengthened interconnection between the struts and a firmly established central location for the intersection of the struts.

SUMMARY OF THE INVENTION

The present invention relates to frame brace trucks in which a pair of cross struts are used to stabilize the truck and improve the resistance to relative longitudinal movement between the side frames.

A primary purpose of the invention is to provide an improved and substantially strengthened clamp assembly for attaching the cross braces between the side frames.

Another purpose is to provide a clamp assembly of the type described which eliminates the elastomeric member of the prior art.

Another purpose is to provide a clamp assembly as described in which there are a pair of facing clamp plates, each welded to a strut, with the clamp plates being welded one to another.

Other purposes will appear in the ensuing specification, drawings and claims.

BRIEF DESCRIPTION OF THE DRAWINGS

The invention is illustrated diagrammatically in the following drawings wherein:

FIG. 1 is a side view of a rail car truck of the type disclosed herein;

FIG. 2 is a bottom view of the rail car truck of FIG. 1;

DESCRIPTION OF THE PREFERRED EMBODIMENT

Figures 3, 4, 5, 6, 7:
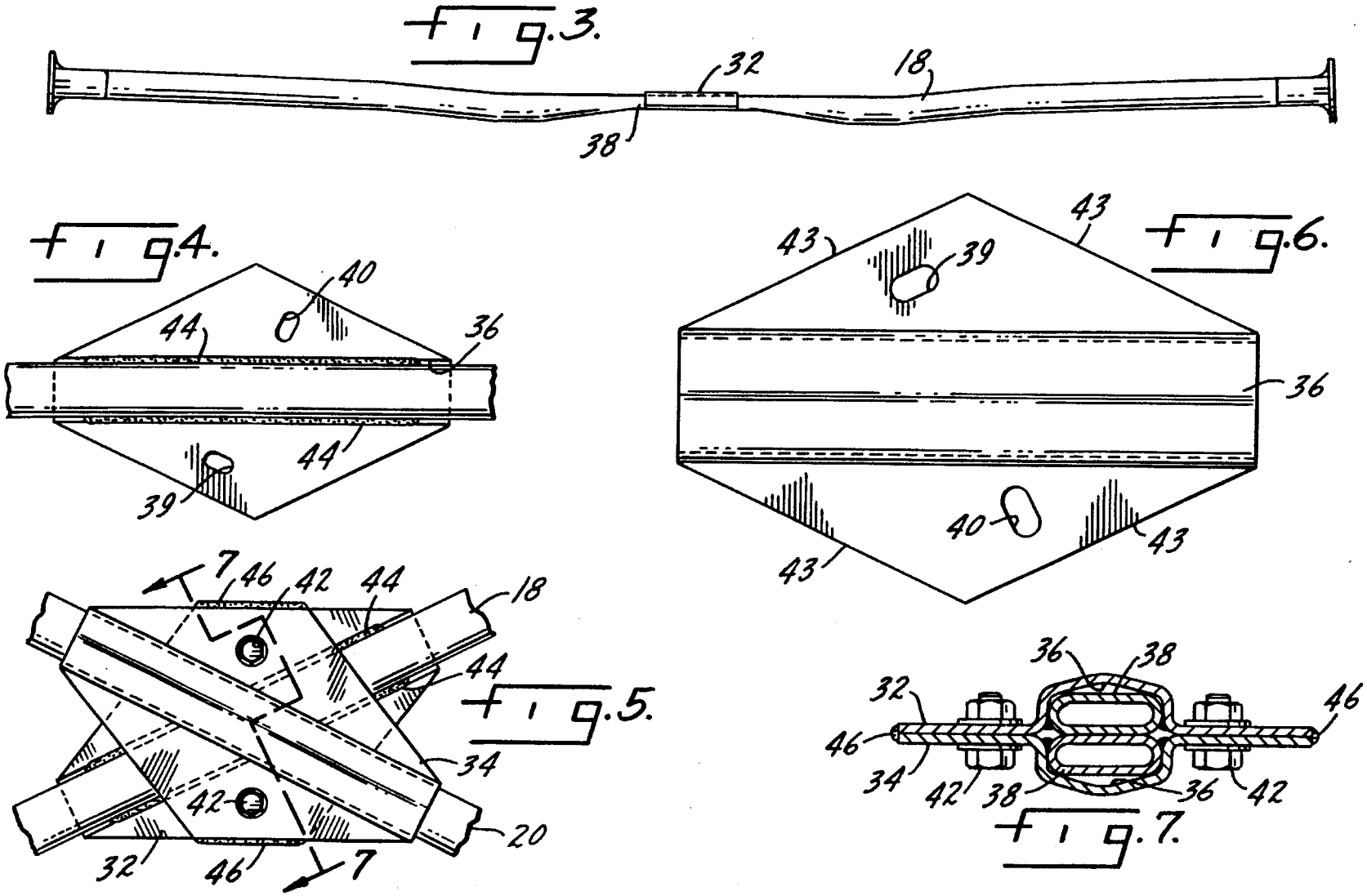
FIG. 3 is a side view of the strut used in the rail car of FIGS. 1 and 2.
FIG. 4 is a top view of a clamp plate and its associated strut illustrating the weld holding these two members together.
FIG. 5 is a top plan view of the clamp assembly.
FIG. 6 is an enlarged top view of a clamp plate.
FIG. 7 is a section along plane 7—7 of FIG. 5.

U.S. Pat. No. 4,570,544 discloses a railroad truck having a pair of side frames supported on conventional longitudinally spaced wheelsets. To improve truck stability, cross braces extend between the side frames to increase the resistance to side frame relative longitudinal movement. Elastomeric members are placed between the wheelsets and the side frames to decrease the yaw stiffness of the wheelsets. As a result, the yaw stiffness and lateral stiffness of the truck can be selected to provide optimum truck stability.

U.S. Pat. No. 5,243,920 discloses an improvement for the '544 truck specifically in the area of the clamp that holds the cross braces together at a location generally at the mid-point between the side frames. The clamp assembly of the '920 patent did not provide sufficient strength and the present invention is specifically concerned with a strengthened clamp assembly and one which does not require the elastomeric member as a spacing element between the two plates forming the clamp assembly.

In the drawing, conventional side frames are indicated at 10 and are mounted on wheelsets 12 and 14. Conventional roller bearings mount the wheelsets and the side frames are connected by a bolster 16. The bolster is supported on the side frame by springs 17, as is conventional.

Cross braces 18 and 20 are diagonally connected between the side frames to provide the desired resistance to relative longitudinal movement between the side frames. Each end of a cross brace or cross strut 18, 20 is attached to a side frame by means of a mounting bracket 22 which is attached by a base plate 24 to the side frame. An end block assembly 26 is attached to the brackets 22 and has a nose, not shown, which extends within and supports each of the cross braces 18 and 20. The end block assembly and the mounting therefor includes an elastomeric element to provide yaw and lateral stiffness.

The clamp assembly is indicated generally at 30 and is shown in detail in FIGS. 4–7. The clamp assembly includes an upper clamp plate 32 and a lower clamp plate 34, the clamp plates being identical in configuration. Each clamp plate includes a generally central trough 36 within which is positioned a central flattened portion 38 of one of the struts 18 or 20. The plan view of each clamp plate, as illustrated in FIG. 6, shows that the clamp plates have the general shape of a parallelogram with the trough running generally along the longer axis of the clamp plate. The four edges or sides 43 of each clamp plate are generally equal in length. On opposite sides of each clamp plate there are openings 39 and 40 to accommodate bolts or threaded fasteners indicated at 42, there being one such fastener on each side of the clamp plates, when assembled, as illustrated in FIGS. 5 and 7.

Each clamp plate is welded to a cross strut, as indicated by the weld beads 44 in FIG. 4. Further, once the clamp plates are assembled into the unit illustrated in FIGS. 5 and 7, the clamp plates are welded together along adjacent edges, as indicated by the weld beads 46 in FIG. 7.

In use, the clamp assembly provides a rigid, strong interconnection between the cross struts or cross braces. Each of the struts is welded to a clamp plate, and after the clamp plates are assembled to the configuration of FIG. 7, they are welded together along adjoining edges. Fasteners are used to hold the clamp plates in the desired position prior to the final welding operation. The clamp plates are considerably enlarged over the plates illustrated in the above-described '920 patent. Further, the elastomeric pad which was positioned between the clamp plates in the '920 patent has been eliminated and the configuration of the clamp plates is substantially different.

Whereas the preferred form of the invention has been shown and described herein, it should be realized that there may be many modifications, substitutions and alterations thereto.

The embodiments of the invention in which an exclusive property or privilege is claimed are defined as follows:

1. A truck comprising a pair of longitudinally spaced wheelsets, a pair of laterally spaced side frames extending between and supported by said wheelsets, a bolster extending between said side frames to support a vehicle body, and a brace connected between said side frames to control relative longitudinal movement therebetween, said brace including a pair of struts oppositely inclined to the longitudinal axis of the truck and each extending between the side frames, said struts intersecting generally centrally of said side frames, and a clamp assembly for attaching said struts at their intersection, said clamp assembly including a pair of clamp plates, each plate having a generally parallelogram configuration, and having a generally central channel formed and adapted to receive a strut, each clamp plate being welded to a strut, fastening means attaching facing surfaces of said clamp plates in direct contact with each other, each clamp plate having four sides, said clamp plates being welded one to another along adjacent sides thereof to inhibit relative movement between said struts in a generally horizontal plane.

2. The truck of claim 1 wherein there are two fastening means, one located on each side of the crossing channels.

3. The truck of claim 1 wherein each plate has a long axis and a short axis, with the plate channel extending along the long axis.

* * * * *